United States Patent [19]

Pernick

[11] 4,223,427

[45] Sep. 23, 1980

[54] METHOD OF KNITTING AND OF PROCESSING HIGH PILE FABRIC

[76] Inventor: David Pernick, 1020 Shore Blvd., Brooklyn, N.Y. 11235

[21] Appl. No.: 951,859

[22] Filed: Oct. 16, 1978

[51] Int. Cl.[3] ..... D06C 11/00; D06C 13/00; D06C 23/02; D05B 1/00

[52] U.S. Cl. ..... 28/159; 112/262.1

[58] Field of Search ..... 28/159, 141; 112/79 A, 112/410, 440, 411, 441, 262.1; 66/191

[56] References Cited

U.S. PATENT DOCUMENTS

| | | | |
|---|---|---|---|
| 1,661,018 | 2/1928 | Stroud | 28/159 X |
| 1,986,491 | 1/1935 | Wilson | 112/410 |
| 2,690,661 | 10/1954 | Briggs | 28/159 X |

FOREIGN PATENT DOCUMENTS

| | | | |
|---|---|---|---|
| 520965 | 5/1940 | United Kingdom | 28/141 |

*Primary Examiner*—Ronald Feldbaum
*Attorney, Agent, or Firm*—Nathan Levin

[57] ABSTRACT

Tubular knitted high pile fabric of indefinite length is formed in a novel manner so that after walewise split lengths of the tubular fabric are coursewise seamed together to form an indefinite length of flat high pile fabric, the seam can be so formed that the flat fabric is able to pass through the fabric finishing apparatus without damage to the apparatus by the seam and without special control of the apparatus to permit the seam to pass therethrough. The novel tubular knitted high pile fabric is specially formed with the pile omitted at walewise spaced courses thereof to form walewise spaced bands of non-pile fabric, and the seam is then formed in the non-pile fabric.

4 Claims, 5 Drawing Figures

METHOD OF KNITTING AND OF PROCESSING HIGH PILE FABRIC

Figure 2:
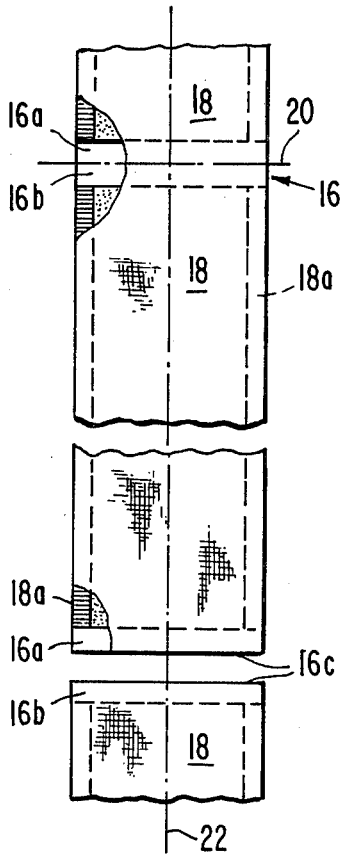

The present invention relates generally to the art of knitting and of finishing knitted fabric, and more particularly to the production of tubular knitted high pile fabric and to the finishing thereof. The tubular knitted high pile fabric of the present invention is of novel formation, and is so made as to facilitate the finishing operations to which the fabric is subjected.

It has been the practise to knit an indefinite length of tubular high pile fabric of uniform formation upon circular knitting machines, an example of which is shown in U.S. Pat. No. 3,299,672 to Schmidt, then to form the tubular high pile fabric into an indefinite length of flat high pile fabric, and then to subject such flat fabric to finishing operations to enhance the appearance thereof. Tubular knitted high pile fabric is made by knitting yarn and slivers together on the needles of a circular knitting machine to form the yarn into the stitches of wales and courses of a tubular knitted base fabric, while, at the same time, incorporating the slivers in the stitches so as to form the pile extending from the base fabric. The tubular high pile fabric is changed to flat high pile fabric in order to pass through the finishing apparatus. The flat fabric is formed by, (a) coursewise severing the tubular fabric to provide individual sections or tubular lengths thereof, (b) walewise severing the individual lengths of tubular fabric and unfolding the same to lie flat, and (c) coursewise seaming the flattened lengths of fabric together, end to end, along their severed edges. In so doing, the seam joining the flattened lengths of fabric encloses therein the pile and the pile fabric at and adjacent to their coursewise severed edges. The seam is relatively difficult to sew due to the presence of the pile, and is quite bulky due to the inclusion therein of the pile and pile fabric. Such seam and the pile fabric adjacent thereto extends above the plane of the overall pile fabric.

In the above described prior art, the seam and adjacent fabric, due to their bulk, are the cause of certain difficulties in the fabric finishing operations. As the fabric travels through the finishing apparatus, extreme care must be taken to see that the apparatus is not damaged by the passage of such seam and adjacent fabric. The operation of the finishing apparatus must be controlled so that the bulky seams and the fabric adjacent thereto are not subjected to the finishing operations. For example, the shear blade is moved so as not to be operative upon the seam and adjacent fabric. As a further undesirable result, there is a substantial financial loss due to the fact that the unfinished fabric adjacent to and in the seam is useless and must be discarded.

The present invention overcomes the above difficulties of the prior art by making the tubular knitted high pile fabric of novel formation so that the seams joining the flattened sections thereof enclose only the base fabric therein. As a result, it is easier to sew the seam, the operation of the finishing apparatus is safer and more efficient, and there is financial gain in that there is no longer any unfinished pile fabric to be discarded.

It is an object of the present invention to provide novel tubular knitted high pile fabric of indefinite length in which in corporation of the slivers in the tubular base fabric is discontinued at selected walewise spaced intervals thereof for a predetermined number of courses, thereby to provide a series of alternately disposed individual sections or lengths of tubular knitted high pile fabric and bands or sections of tubular knitted non-pile base fabric, the latter being formed by said courses.

It is a further object of the present invention to change said novel tubular fabric to an indefinite length of flat pile fabric by coursewise severing said bands of non-pile base fabric, then walewise severing the resulting sections of tubular fabric and unfolding the same to lie flat, and then coursewise seaming together the severed edges of said bands of non-pile base fabric. The seams of the resulting flat pile fabric have no pile or pile fabric therein and are such as not to interfere with the continuous operation of the finishing apparatus during the passage of the fabric therethrough.

Figure 1:
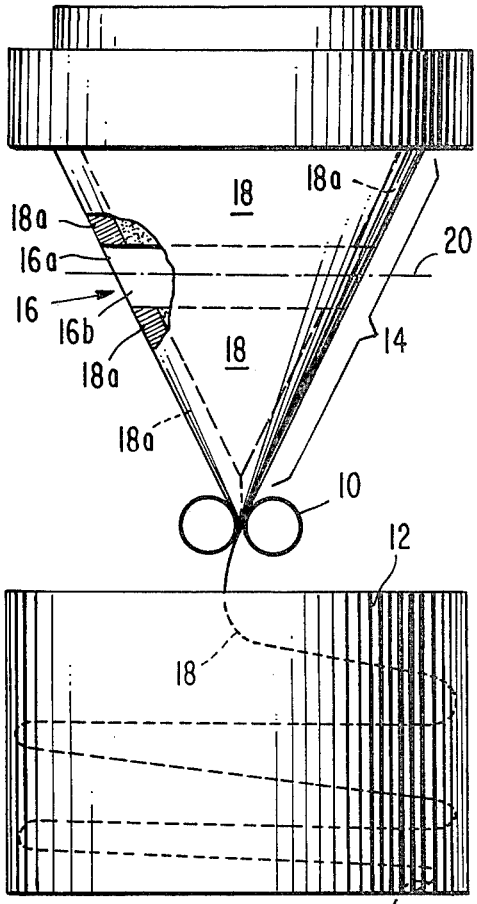
Figure 3:
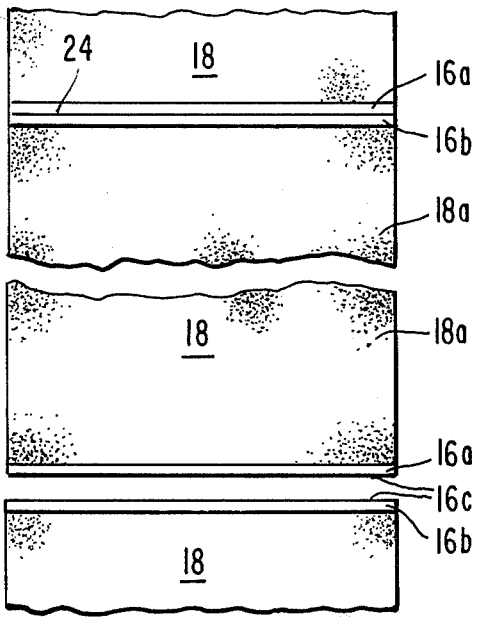
Figure 4:
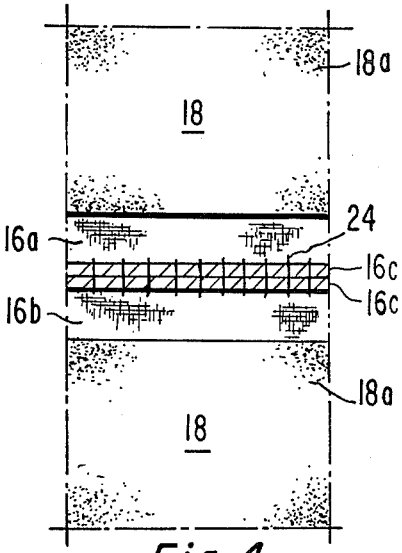
Figure 5:
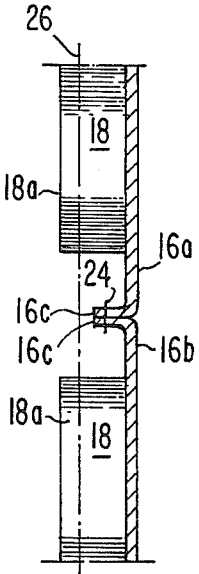

In the drawings:

FIG. 1 is a schematic view of a circular knitting machine of the type used to make tubular knitted high pile fabric and which is used to make the novel fabric of the present invention, FIG. 2 is a plan view of the fabric of the present invention as made upon the machine of FIG. 1, showing a series of alternate sections or lengths of tubular knitted high pile fabric and sections or bands of tubular knitted non-pile base fabric, FIG. 3 is a view generally similar to FIG. 2 after the tubular fabrics thereof have been walewise severed and have been unfolded to extend as single layers of fabric, FIG. 4 is a plan view of a portion of FIG. 3 showing the high pile fabric of adjacent lengths thereof and the band of non-pile fabric therebetween, and FIG. 5 is a side view of the fabric of FIG. 4.

The fabric of the present invention may be made upon a circular knitting machine of the type used to make tubular knitted high pile fabric, such as the machine shown in the said Schmidt patent. In such a machine, suitable yarn is fed to the needles thereof to knit a tubular base fabric of wales and courses, and, at the same time, suitable slivers or rovings of fibers are also fed to the needles, the fibers being incorporated in and extending from the stitches of the base fabric, thereby to produce conventional tubular knitted high pile fabric.

In order to make the novel fabric of the present invention, the operation of the machine is modified, either manually or automatically under pattern control, to periodically discontinue the feeding of the slivers at selected intervals during the knitting of the base fabric for a predetermined number of courses thereof. The result is to form a series of alternate sections or lengths of tubular knitted high pile fabric and of sections or bands of tubular knitted non-pile base fabric. The high pile fabric is formed when the yarn and the slivers are both fed to the needles while the non-pile fabric is formed when only the yarn is fed to the needles.

As in FIG. 1, tubular fabric extends from a rotary needle cylinder (not shown) upon which it is made, to and through take-up rollers 10, and into a basket 12. The take-up and the basket rotate with the cylinder. The fabric extending between the cylinder and the take-up is bracketed at 14 with a section 16 between adjoining sections 18, 18 thereof. The sections 18, 18 are each of high pile fabric while the section 16 is of non-pile base fabric, the latter being free of the pile forming slivers.

The base fabric of sections 16, 18, 18 is continuous and the pile of sections 18, 18 is shown at 18*a*. A dot dash line 20 extends midway of section 16 and divides the same into similar half sections 16*a*, 16*b*. The walewise extent of section 16 may vary as desired, generally being from 3 to 6 inches long or longer and for a purpose to be set forth. The sections 18, 18 are of high pile fabric and are made when both the yarn and the slivers are fed to the needles, while section 16 is of non-pile base fabric and is made when only the yarn is fed to the needles. The length of sections 18 may vary, being a matter of selection or of the basket capacity of a particular machine, and may be hundreds of feet long. The fabric accumulates in basket 12 after passing through the takeup rolls 10. After a predetermined amount of fabric has so acculated, the machine is stopped with a band section 16 just below the take-up. Section 16 is then coursewise severed along line 20, the fabric is removed from the basket, and the machine is restarted to continue knitting.

As in FIG. 2, severing of section 16 of non-pile base fabric on line 20 provides individual lengths of high pile fabric 18 with terminal half bands **16*a*, 16*b* of base fabric extending from the ends thereof. The severed ends of such half bands are shown at 16*c*, 16*c*. Each tubular length of high pile fabric 18 and its half bands 16*a*, 16*b* are then walewise severed along line 22. Such severed fabric is then unfolded and flattened out to extend as a single layer of fabric, FIG. 3. Two lengths of flattened fabric 18 are then re-joined by sewing together edge 16*c* of half band 16*a* of one length of fabric 18 and edge 16*c* of half band 16*b* of the other length of fabric 18. The half bands 16*a*, 16*b* are joined by a seam of any desirable construction of which one type thereof is shown at 24**. Any desirable sewing machine may be used to form the seam.

It will be noted, FIG. 5, that seam 24 has no pile or pile fabric therein and is below the plane of the pile fabric, even after the latter has been sheared to line 26 during the finishing operation. It is much easier to sew the sections together since the seam 24 joins only non-pile base fabric. The seam causes no damage to the finishing apparatus as the fabric passes therethrough and it no longer need be watched because of the passage of the seam. The bands 16 are ultimately discarded, and since such bands are of base fabric only, any financial loss resulting therefrom is minimal. It may at times happen that a certain amount of the slivers might become incorporated in the base fabric of band 16, and, accordingly it is within the scope of the present invention to practise the same with bands 16 in which there is a lesser than normal amount of pile therein, so long as the objects of the invention are still attained.

I claim:

1. Improvement in a process for finishing the pile of high pile knit fabric of indefinite length wherein individual lengths of tubular high pile knit fabric are walewise. severed and are then coursewise joined in end-to-end relation to provide the indefinite length of the high pile knit fabric preparatory to the processing of the pile thereof, and wherein the improvement includes the steps of providing the individual lengths of tubular high pile knit fabric during the knitting thereof with terminal courses which are substantially free of the pile, and the step of coursewise joining the fabric of said pile-free terminal courses of said individual lengths of said pile knit fabric in end-to-end relation to provide the indefinite length thereof preparatory to the processing of its pile, the fabric of said pile-free terminal courses not being subjected to the processing operation and being subsequently treated as disposable waste material.

2. Improvement as in claim 1 wherein said terminal courses are joined by sewing.

3. Improvement as in claim 2 wherein less than all of said terminal courses are joined.

4. Improvement as in claim 1 wherein said terminal courses are provided at both ends of each of the individual lengths of high pile fabric.

* * * * *